US008711049B2

(12) United States Patent
Fehrenbach et al.

(10) Patent No.: US 8,711,049 B2
(45) Date of Patent: Apr. 29, 2014

(54) POTENTIAL SEPARATION FOR FILLING LEVEL RADAR

(75) Inventors: Josef Fehrenbach, Haslach (DE); Daniel Schultheiss, Hornberg (DE); Karl Griessbaum, Muehlenbach (DE)

(73) Assignee: Vega Grieshaber KG, Wolfach (DE)

( * ) Notice: Subject to any disclaimer, the term of this patent is extended or adjusted under 35 U.S.C. 154(b) by 887 days.

(21) Appl. No.: 12/640,623

(22) Filed: Dec. 17, 2009

(65) Prior Publication Data

US 2010/0123615 A1 May 20, 2010

Related U.S. Application Data

(63) Continuation-in-part of application No. 11/496,592, filed on Jul. 31, 2006, now abandoned.

(60) Provisional application No. 60/705,596, filed on Aug. 4, 2005.

(30) Foreign Application Priority Data

Aug. 4, 2005 (DE) ..... 10 2005 036 844

(51) Int. Cl.
*H01Q 13/00* (2006.01)
*H01P 1/04* (2006.01)

(52) U.S. Cl.
USPC ..... 343/786; 343/906; 333/254

(58) Field of Classification Search
USPC ..... 343/786, 906; 342/124; 73/290 R; 439/916; 333/245, 248, 254–257, 260
See application file for complete search history.

(56) References Cited

U.S. PATENT DOCUMENTS

| | | | | |
|---|---|---|---|---|
| 5,363,464 | A | 11/1994 | Way et al. | |
| 6,202,485 | B1 | 3/2001 | Wien et al. | |
| 6,469,676 | B1 * | 10/2002 | Fehrenbach et al. | 343/786 |
| 6,658,932 | B2 | 12/2003 | Munley et al. | |
| 6,778,044 | B2 | 8/2004 | Fehrenbach et al. | |
| 6,819,299 | B2 | 11/2004 | Miyazaki | |
| 2002/0066314 | A1 | 6/2002 | Lubbers | |
| 2002/0067229 | A1 | 6/2002 | Lubbers | |
| 2002/0125971 | A1 | 9/2002 | Sciarrino | |
| 2003/0137372 | A1 * | 7/2003 | Fehrenbach et al. | 333/245 |
| 2003/0156071 | A1 * | 8/2003 | Miyazaki | 343/786 |
| 2005/0083229 | A1 * | 4/2005 | Edvardsson et al. | 342/124 |
| 2006/0071848 | A1 * | 4/2006 | Edvardsson | 342/124 |

FOREIGN PATENT DOCUMENTS

| | | |
|---|---|---|
| CN | 1 361 928 | 7/2002 |
| DE | 820 455 | 11/1951 |
| DE | 100 60 069 | 4/2002 |
| EP | 0 882 955 | 12/1998 |
| EP | 0 947 812 | 10/1999 |
| EP | 1 058 341 | 12/2000 |

(Continued)

*Primary Examiner* — Robert Karacsony
(74) *Attorney, Agent, or Firm* — Fay Kaplun & Marcin, LLP

(57) ABSTRACT

For safety reasons the potential of an electrical supply line of a radar sensor should be separate from the potential of the filling level container. An arrangement for potential separation for a filling level radar is provided, which arrangement comprises a separation element for insulating the waveguide from the antenna. The separation element, corresponding to the cross section of the waveguide, is ring shaped. In this way rotatability between the sensor housing and the antenna subassembly is provided without influencing the signal line between the antenna and the waveguide.

22 Claims, 5 Drawing Sheets

(56) References Cited

FOREIGN PATENT DOCUMENTS

| | | |
|---|---|---|
| EP | 1 211 490 | 6/2002 |
| EP | 103 02 112 | 7/2003 |
| GB | 623 756 | 5/1949 |
| GB | 680 233 | 10/1952 |
| WO | 98/57392 | 12/1998 |
| WO | 2003/025523 | 3/2003 |
| WO | 2004/048905 | 6/2004 |
| WO | 2005/038414 | 4/2005 |

* cited by examiner

POTENTIAL SEPARATION FOR FILLING LEVEL RADAR

RELATED APPLICATIONS

This application is a Continuation-In-Part of U.S. patent application Ser. No. 11/496,592 filed Jul. 31, 2006 which claims the benefit of U.S. Provisional Patent Application Ser. No. 60/705,596 filed on Aug. 4, 2005 and German Patent Application Serial No. 10 2005 036 844.1 filed on Aug. 4, 2005, the disclosure of all of the above applications is hereby incorporated by reference.

FIELD OF THE INVENTION

The present invention relates to filling level measuring. In particular the present invention relates to a filling level radar with potential separation to determine a filling level in a tank, an antenna and a method to determine a filling level in a tank.

TECHNOLOGICAL BACKGROUND

For reasons relating to measuring technology and for reasons of safety the potential of the electrical supply line of a radar sensor should be separate from the potential of the filling level container, which is often made of metal. This can for example lead to a reduction in the noise effects in measuring, and to a reduction in the susceptibility to interference of the measuring signals. Furthermore, such insulation leads to improved safety, for example in relation to the avoidance of fires that can occur as a result of a short circuit or a defect in the electrical supply or in the electronics of the filling level radar. Undesired spark-over could, for example, lead to ignition or damage of the contents.

WO 2005/038414 relates to a method and a device to insulate a filling level radar. In this arrangement the electrical insulator is arranged so as to be transverse in relation to an open end of a waveguide. The other end of the waveguide feeds the aerial. In this arrangement the insulator extends continuously over the entire cross section of the waveguide.

SUMMARY OF THE INVENTION

According to an exemplary embodiment of the present invention, a filling level radar for determining a filling level in a tank is provided, the filling level radar comprising a first waveguide and a second waveguide. Between the two waveguides a separation element is positioned which is adapted for galvanically, i.e. electrically insulating the first waveguide from the second waveguide. The separation element comprises a tubular section coaxially aligned with the first waveguide and the second waveguide.

The tubular section has a longitudinal axis which is identical to the longitudinal axis of the first and second waveguides and serves as a creepage path.

According to another exemplary embodiment of the present invention, the tubular section of the separation element has an axial length which is about four times larger than a thickness of the separation element. For example, the axial length of the tubular section is about 2 mm and the thickness of the separation element is, at least in most regions of the separation element, about 0.5 mm.

According to another exemplary embodiment of the present invention, the first waveguide has a first inner diameter, the second waveguide has a second inner diameter and the tubular section of the separation element has a third inner diameter which is smaller than the first in a diameter and the second in a diameter.

According to another exemplary embodiment of the present invention, the separation element is adapted for being inserted into the second waveguide, wherein the separation element comprises a nose section and wherein the second waveguide comprises a groove section. The nose section engages the groove section when the separation element is inserted into the second waveguide thus forming a releasable connection between the separation element and the second waveguide after insertion.

Furthermore, according to another exemplary embodiment of the present invention, an antenna for a filling level meter for transmitting or receiving electromagnetic waves is provided. The antenna comprises a second waveguide and a separation element to connect the second waveguide to an external first waveguide of the filling level meter and to insulate the second waveguide from the first waveguide galvanically, i.e. electrically. Furthermore, the separation element comprises a tubular section coaxially aligned with the first waveguide and the second waveguide.

According to another embodiment of the present invention a filling level radar with potential separation to determine a filling level in a tank is stated, the filling level radar comprising an antenna for transmitting and/or receiving electromagnetic waves, a feed device for feeding the electromagnetic waves to the antenna, and a separation element for insulating the feed device from the antenna, wherein the separation element comprises a recess in longitudinal direction of the feed device, and wherein the separation element comprises a region of overlap for overlapping in longitudinal direction at least the feed device or the antenna.

By designing the separation element with a recess in longitudinal direction of the feed device, for example unimpeded or uninfluenced propagation of the electromagnetic waves within the feed device, and from the feed device to the antenna (and back), may be ensured. In the case of a feed device with round cross section the separation element may for example be ring shaped, while in the case of a feed device with rectangular cross section the separation element may be rectangular (with a rectangular recess that corresponds to the inner circumference of the feed device in longitudinal direction (i.e. in the direction of propagation of the waves).

According to a further embodiment of the present invention the feed device comprises a first waveguide and a radiation source, wherein the radiation source is designed to generate the electromagnetic waves, and wherein the first waveguide is designed to guide the electromagnetic waves from the radiation source to the antenna.

According to a further embodiment of the present invention the filling level radar further comprises a second waveguide that is connected to the antenna, wherein the separation element is arranged between the first waveguide and the second waveguide.

According to this embodiment of the present invention insulation is provided between a first waveguide and a second waveguide. In this way the antenna may be insulated from the first waveguide; however, when viewed locally, such insulation is not in place directly between the first waveguide and the antenna, but instead at a distance from the antenna, namely between the first waveguide and a second waveguide that is connected to the antenna.

According to a further embodiment of the present invention a connection between the separation element and the feed device, or between the separation element and the second waveguide, or (for example if there is no second waveguide)

between the separation element and the antenna, is designed such that the feed device is rotatably held relative to the antenna.

In this way it is for example possible to provide rotatability between the sensor housing with installed circuit and the antenna subassembly. This improves the flexibility of the filling level radar because changing environmental conditions or installation conditions can often require other sensor housing positions.

Furthermore, depending on interfering installations in containers, e.g. baffles, which also generate reflections apart from those of the contents' surface, and which thus make measuring more difficult, it may be advantageous that the polarisation of the electromagnetic wave that is transmitted by the antenna can be rotated. By means of such polarisation rotation, certain interfering reflections may be minimised so that in this way measuring of the contents becomes more reliable and more accurate. If merely the complete filling level sensor is rotated in its installed position, in the case of sensors with flange attachments this would mean that all installation screws of the flange would have to be undone, and in accordance with the hole division of the flange said flange would have to be rotated for example in 90° or 60° steps. This does not support any fine adjustment of the polarisation beyond the incremental steps predefined by the hole division.

In the case of sensors with a screw thread, the polarisation rotation has to take place by corresponding rotation of the screw thread, which while it is possible at the required fine adjustment, can however pose problems in relation to the sealing function of the thread.

By means of the rotatability between the separation element and the feed device, or between the separation element and the antenna, which rotatability has been proposed in the present invention, polarisation rotation may take place without the need for rotating the antenna, which normally establishes a firm mechanical connection with the flange or the screw thread. With the position of the flange attachment or of the screw thread unchanged, the polarisation by rotation of the feed device, if need be coupled with the sensor housing, may be rotated at the desired fine adjustment, without installation effort and without impeding the tightness of the container.

According to a further embodiment of the present invention the cross section of the first waveguide differs from that of the second waveguide.

In this way it is for example possible for the separation element to make possible expansion of the diameter of the waveguide in that the separation element, for example, bridges the difference between the diameter of the first waveguide and the diameter of the second waveguide.

According to a further embodiment of the present invention the filling level radar further comprises a cross-section adaptor between the first waveguide and the second waveguide or the antenna in the region of the separation element, wherein the first waveguide in relation to the frequency of the signals to be transmitted is monomode-dimensioned, and wherein the second waveguide or the antenna is multimode-capable. This characteristic directly results from the ratio of waveguide diameter to wavelength of the transmitted microwave signals. In this arrangement the cross-section adaptor is dimensioned in such a way that in the second waveguide or in the antenna it generates no higher modes or only insignificantly higher modes than the fundamental mode.

According to this embodiment of the present invention the insulation of the first waveguide of the antenna or of a second waveguide can be combined with a cross-section adapter.

In this way it may for example be possible to reduce the sensitivity to condensate droplets as a result of the comparatively large diameter of the second waveguide or of the antenna, while in spite of multimode capability of the second waveguide or of the antenna no echoes that falsify the measuring signals occur any longer while at the same time insulation between the first waveguide and the antenna is ensured.

According to a further embodiment of the present invention the cross-section adapter and the separation element are designed in the form of a tight connection between the first waveguide and the second waveguide or between the first waveguide and the antenna.

In this way materials conveyance between a tank on the side of the antenna and the outside environment on the side of the waveguide may be prevented. Thus, it may for example be possible to avoid corrosion or other damage or destruction of the filling level radar above the antenna or above the second waveguide. Furthermore, in this way any unwanted feed-in of solid, liquid or gaseous materials into the tank may be prevented.

According to a further embodiment of the present invention the antenna is designed as a horn antenna, parabolic antenna or bar antenna. In this way it is possible to separate different antennae from the potential of the first waveguide.

According to a further embodiment of the present invention the waveguide is designed as a round waveguide or a rectangular waveguide.

According to a further embodiment of the present invention a region of overlap is provided between the first waveguide and the second waveguide and/or the antenna, wherein the first waveguide is insulated from the second waveguide and/or from the antenna in the region of overlap by means of the separation element. The first waveguide is designed to transmit a signal with a wavelength of $\lambda$, while the length of the region of overlap is $\lambda/4$ in longitudinal direction.

The above is used for electrically matching the transition region in which potential separation takes place. Normally, interrupting the metal wall of the waveguide unfavourably affects the high-frequency characteristics of the waveguide. By means of a so-called $\lambda/4$-transformer mutual impedance matching of the two separate waveguides can be improved. An open-circuited stub line with a length of $\lambda/4$ transforms a short circuit to its input. The region of overlap with the separation element that is arranged in between acts as such an open-circuited stub line. The open circuit in the direction of the outer jacket of the waveguide is transformed as a short circuit into the region of the inner jacket of the waveguide. The high-frequency-like short circuit at this direct-voltage-like nonconducting seam position favours onward transmission of the microwaves, thus causing a reduction in interfering reflections.

According to a further embodiment of the present invention the connection between the separation element and the feed device, or between the separation element and the second waveguide, or (if there is no second waveguide) between the separation element and the antenna, is constructed in the form of a plug-type connection so that the feed device can be unplugged from the antenna or from the second waveguide.

By designing the arrangement with a disconnectable connection, through which the entire top part of the filling level radar can be unplugged from the antenna or from the lower (second) waveguide, the electronics together with the first waveguide may in a simple manner be deinstalled, i.e. replaced. This may improve the flexibility of the arrangement, in particular in the case of repair or maintenance.

According to a further embodiment of the present invention the separation element is designed for electrically insulating the feed device from the antenna. For example, the separation element is dimensioned such that adequate electrical insulation up to a specified maximum voltage is ensured.

Furthermore, according to another embodiment of the present invention, the separation element is designed to thermally insulate the feed device from the antenna. This can in particular, for example, be advantageous if the thermal conditions in the interior of the tank are to be kept constant and are to be insulated against thermal influences from the outside.

Likewise, in the case where the temperatures in the container are extreme it may be advantageous to largely keep these temperatures away from the electronics so as not to risk influencing the function, or even failure of the electronics as a result of such temperatures.

For the purpose of electrical insulation the separation element may comprise a dielectric.

According to a further embodiment of the present invention the separation element is designed as a dielectric barrier that comprises a layer of rigid dielectric material.

According to a further embodiment of the present invention an antenna for transmitting and/or receiving electromagnetic waves is stated, wherein the antenna comprises a separation element to insulate the antenna from a feed device, wherein the feed device is designed to feed the electromagnetic waves to the antenna, and wherein the separation element comprises a recess in longitudinal direction of the waveguide.

Such an antenna may be used as a modular component for a filling level radar, wherein insulation between the antenna and the electronics is ensured.

According to a further embodiment of the present invention the feed device comprises a first waveguide and a radiation source, wherein the radiation source is designed to generate the electromagnetic waves, and wherein the first waveguide is designed to guide the electromagnetic waves from the radiation source to the antenna.

According to a further embodiment of the present invention a method for potential separation for a filling level radar is provided, wherein feeding electromagnetic waves to an antenna takes place by way of a feed device. Furthermore, the electromagnetic waves are transmitted and/or received by an antenna. Moreover, the feed device is insulated from the antenna by means of a separation element, wherein the separation element comprises a recess in longitudinal direction of the feed device.

In this way a method may be provided by which potential separation between, on the one hand, an (upper) feed device and electronics that are connected to said feed device, and, on the other hand, to a (lower) antenna is made possible, wherein the insulation has no influence on the signal line.

According to a further embodiment of the present invention the electromagnetic waves are guided by a first waveguide of the feed device and a second waveguide, which is connected to the antenna, wherein the separation element is arranged between the first waveguide and the second waveguide.

In this way insulation of the first waveguide from the second waveguide may be achieved. In this arrangement the insulation may not depend on the antenna.

Further embodiments of the present invention are disclosed in the subordinate claims.

BRIEF DESCRIPTION OF THE DRAWINGS

Below, preferred exemplary embodiments of the present invention are described with reference to the figures.

DETAILED DESCRIPTION OF EXEMPLARY EMBODIMENTS

Figure 1:
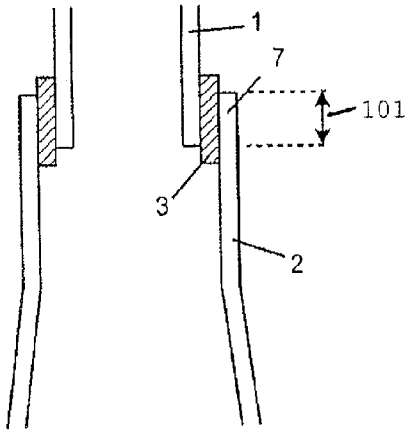
FIG. 1 shows potential separation according to one embodiment of the present invention.

In the following description of the figures, the same reference characters are used for identical or similar elements.

FIG. 1 shows an arrangement for potential separation for a filling level radar according to one embodiment of the present invention. As shown in FIG. 1 the arrangement comprises a first waveguide 1 and a second waveguide 2 which are insulated from each other by means of a separation element 3. In this arrangement the separation element 3 comprises a recess in longitudinal direction along the waveguides 1, 2. This arrangement may for example be a round arrangement or even a rotationally symmetrical arrangement. Of course the first and second waveguide 1, 2 and the separation element 3 could also be of angular cross section (rectangular or polygonal) or of some other completely different cross section.

The waveguides 1, 2 are used to guide electromagnetic waves, in particular microwaves, with a frequency of for example 6-85 GHz. Of course, the waveguides 1, 2 can also be designed to guide electromagnetic radiation of a higher frequency. Likewise, guiding electromagnetic radiation of a lower frequency than 6 GHz is possible.

The separation element 3 shown is for example a dielectric that is designed in particular for electrical insulation between the first waveguide 1 and the second waveguide 2. To this effect the dielectric 3 is of a thickness that is sufficient to provide adequate electrical insulation. For example, the thickness can be dimensioned such that only from a certain maximum voltage between the first waveguide 1 and the second waveguide 2 does noticeable current conduction between these two elements 1, 2 occur by way of the separation element 3. A typical thickness for such a separation element 3 is for example 0.5 mm. Of course, the separation element 3 can also be considerably thicker, or thinner (in cases where the maximum voltage is lower).

As shown in FIG. 1, a region 7 of overlap between the first waveguide 1 and the second waveguide 2 is provided, which region advantageously is of a length of almost λ/4 (indicated by arrow 101) wherein λ designates the fundamental mode guided in the waveguide 1. This λ/4-transformation path transforms a short circuit for the electromagnetic waves to the transition region between the first and the second waveguide. In this way the waves are guided past this position largely without any reflection.

The lower (second) waveguide 2 has a larger cross section than the upper (first) waveguide 1. This expansion of the cross section is made possible in a simple manner by the separation element 3. For example, this expansion of the diameter results in a reduction in the susceptibility of the antenna (reference character 5 in FIG. 8) to interference in relation to the formation of condensate droplets within the antenna.

The connection between the first waveguide 1 and the separation element 3 and/or between the separation element 3 and the second waveguide 2 is designed such that the two waveguides 1, 2 are held so as to be rotatable in relation to each other. Consequently, subsequent rotary adjustment, relative to the antenna, of the upper waveguide 1 (and thus of the housing that is situated on it, including the electronics) is possible even when the antenna is installed (which antenna is firmly connected to a flange in the cover of the filling level container). In this way the antenna and the sensor housing with built-in circuit can be rotated in relation to each other. This makes possible infinitely variable polarisation rotation, without having to change the installation position of the antenna and the flange or the screw thread.

Figure 2:
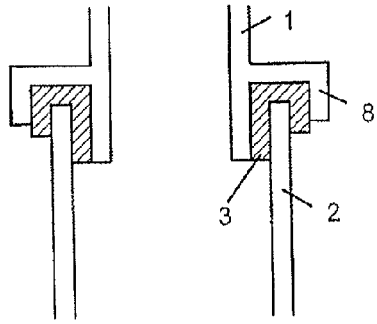
FIG. 2 shows potential separation according to a further embodiment of the present invention.

FIG. 2 shows a further arrangement for potential separation for a filling level radar according to a further embodiment of the present invention. In this arrangement the upper waveguide 1 is insulated from the lower waveguide 2 with the aid of the separation element 3, wherein the connection between the first waveguide 1 and the second waveguide 2 is carried out in the form of a plug-type connection. In this arrangement the separation element 3 can for example be firmly connected to the first waveguide 1, after which the second waveguide 2 can be pushed into or pulled out from the separation element 3 in the manner of a plug. Of course, as an alternative, the separation element 3 can also be firmly connected to the second waveguide 2 so that the combination comprising the separation element 3 and the second waveguide 2 can be plugged into or pulled out from the channel 8 formed by the first waveguide 1. Of course, the separation element 3 can also be firmly connected with each of the two waveguides 1, 2, for example if mechanical detachability is not desirable.

In this arrangement, too, the length of the gap between the overlapping walls of the waveguides can be selected so as to correspond to the example of FIG. 1, namely approximately λ/4, so as to match the impedance of the separation point for the microwaves by way of the λ/4-transformation.

Figure 3:
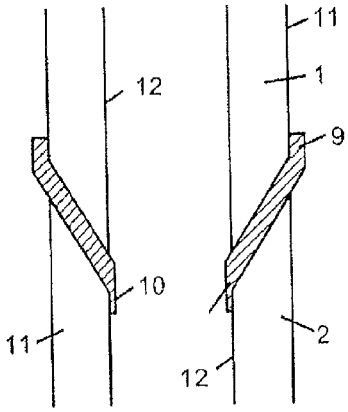
FIG. 3 shows potential separation according to a further embodiment of the present invention.

FIG. 3 shows an arrangement for potential separation for a filling level radar according to a further exemplary embodiment of the present invention. As shown in FIG. 3, the separation element 3 is designed such that it separates the first waveguide 1 from the second waveguide 2. Without insertion of the separation element 3 the waveguides 1, 2 would directly merge into each other. In the case of a rotationally symmetrical design of the waveguides the separation element is designed so as to be cone-shaped, with upper and lower edges 9, 10 that conform to the outside 11 or inside 12 of the waveguides 1, 2. In this way, additional transverse stability is achieved.

Here again, the length of the gap advantageously is approximately λ/4 so as to keep reflections at the separation position to the minimum possible.

Figure 4:
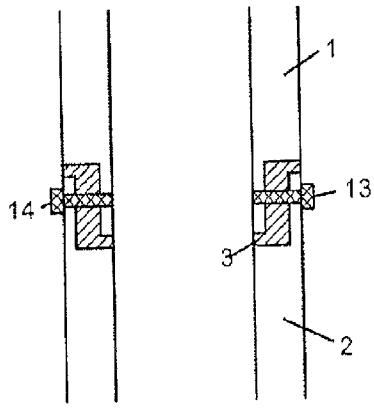
FIG. 4 shows potential separation according to a further embodiment of the present invention.

FIG. 4 shows a further exemplary embodiment of the arrangement according to the invention. In this arrangement the separation element 3 comprises a cross section in the form of a double L. This embodiment shape is particularly suited as a plug-type connection between the two waveguides 1, 2. In this way installation can be facilitated. In addition, detachable or firmly attached bolts 13, 14 or the like, made of insulating material, can be provided in order to affix the combination comprising the waveguides 1, 2 and the separation element 3.

In this arrangement, too, the gap lengths between the waveguide walls can be dimensioned so as to be approximately λ/4.

Figure 5:
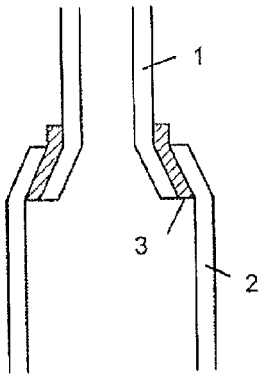
FIG. 5 shows potential separation according to a further embodiment of the present invention.

FIG. 5 shows a further exemplary embodiment of the arrangement according to the invention for potential separation between two waveguides 1, 2. The embodiment shown is in particular suited to expanding the diameter of the waveguides (the diameter of waveguide 1 is smaller than that of waveguide 2). Furthermore, by way of the conical shape, shown in FIG. 5, of the transition between the two waveguides 1, 2, any undesirable sliding apart of the two waveguides 1, 2 is avoided.

Figure 6:
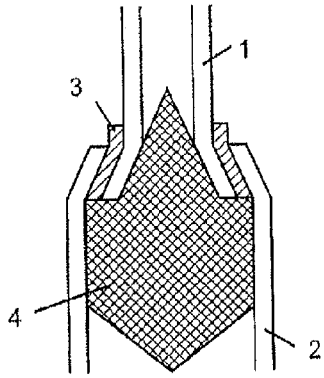
FIG. 6 shows potential separation comprising a cross-section adapter according to a further embodiment of the present invention.

FIG. 6 shows a further exemplary embodiment of the arrangement according to the invention, in which, apart from a diameter expansion, an additional dielectric object 4 is provided as a cross-section adapter. In this arrangement the cross-section adapter 4 is for example designed so as to be pyramidal (in the case of a waveguide of rectangular cross section) or conical (in the case of a round waveguide), in each case tapering into the hollow space of the waveguide 1 and into the hollow space of the waveguide 2. Towards the bottom, the second waveguide, or directly the antenna (not shown in FIG. 6) adjoins the cross-section adaptor 4 without waveguide, which antenna can for example be a horn antenna. In this arrangement the waveguide 1 is monomode-dimensioned. This means that said waveguide only guides a single propagation mode of the wave in relation to the signals to be transmitted. The waveguide 2 is multimode-capable because its diameter is larger. Because of the larger diameter, condensate droplets, which for example reach the antenna and the waveguide 2, cause less interference.

The cross-section adapter 4 and the separation element 3 are designed in the form of a waterproof and/or gasproof connection between the first and the second waveguide 1, 2 so that no conveyance of solids, gases or liquids can take place between the outside environment, the region in the interior of the first waveguide 1 and the region in the interior of the waveguide 2. By means of corresponding additional sealing elements such as for example O-rings between the cross-section adapter 4 and the waveguide wall 2, sealing off of the container can be still further improved.

Figure 7:
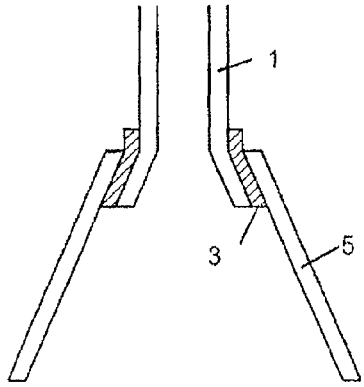
FIG. 7 shows potential separation between a waveguide and an antenna according to a further embodiment of the present invention.

FIG. 7 shows a further exemplary embodiment of the device according to the invention for potential separation. In this arrangement the separation element 3 is used to insulate the first waveguide 1 from a horn antenna 5. There is no need for a second waveguide. Instead, the antenna 5 is connected to the first waveguide 1 (which for example leads directly to the sensor housing) directly by way of the separation element 3.

Figure 8:
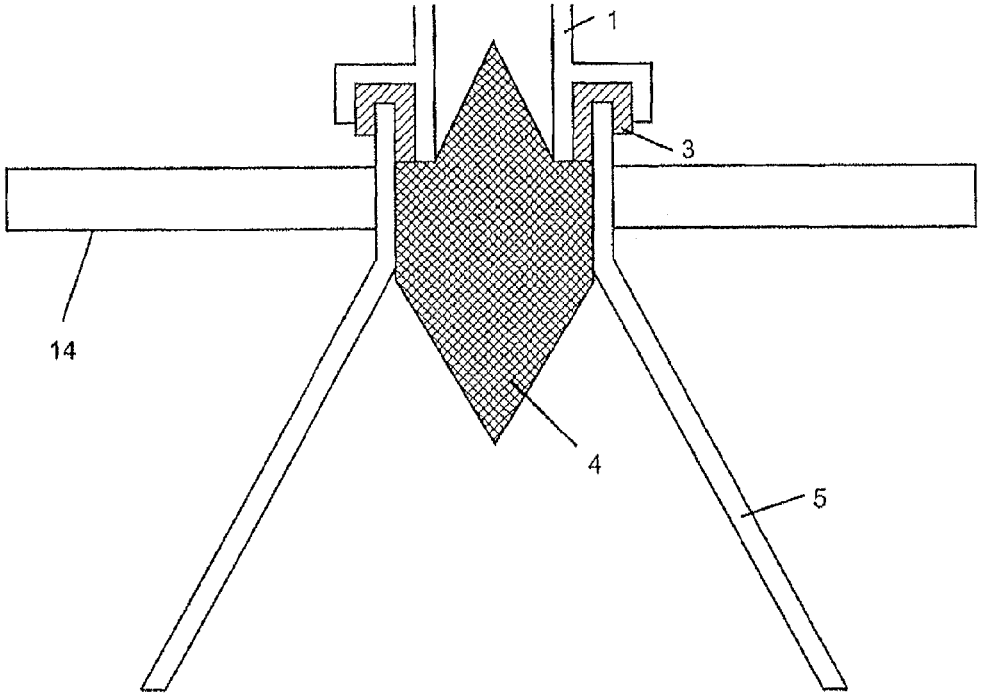
FIG. 8 shows potential separation between a waveguide and an antenna according to a further embodiment of the present invention.

FIG. 8 shows a further exemplary embodiment of the device according to the invention. In this arrangement the separation element 3 comprises a groove into which the horn antenna 5 is inserted. For example, the separation element 3 can be firmly connected to the horn antenna 5 so that subsequently the waveguide 1 can be plugged into place. In the case of a round waveguide 1, the waveguide can be rotated relative to the antenna 5. Furthermore, said waveguide can be removed, and thus exchanged, without further ado. In addition, a cross-section adapter 4 can be provided.

The two dielectric parts 3 and 4 can be constructed either as two separate parts or as a single-piece part both for potential separation and as a cross-section adaptor.

For attachment to the contents container the antenna can be connected to a flange 14, as shown, or in the case of a correspondingly small antenna diameter it can comprise a screw thread instead of the flange 14.

Figure 9:
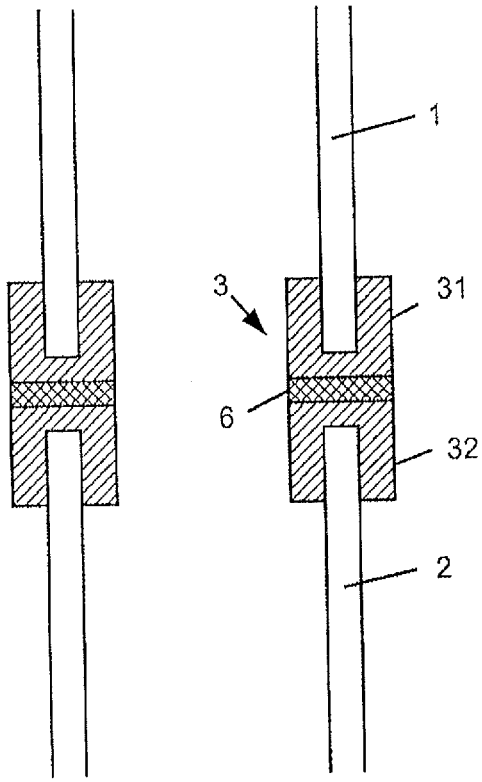
FIG. 9 shows potential separation with thermal insulation according to one embodiment of the present invention.

FIG. 9 shows a further exemplary embodiment of the device according to the invention. In this arrangement the separation element 3 comprises a first region 31 and a second region 32, between which regions thermal insulation 6 is arranged. The thermal insulation 6 can be made in the form of a thermally well-insulating material. For example it can be designed in the form of a vacuum chamber. The first and the second regions 31, 32 are formed by a dielectric material so as to electrically insulate the first waveguide 1 from the second waveguide 2.

Since, generally speaking, electrically insulating materials also provide relatively good thermal insulation, to provide both electrical and thermal insulation it is not necessary to provide separation elements made from two different materials. Instead, all the separation elements for electrical insulation, which separation elements are shown in the various figures, also provide a certain degree of thermal insulation.

Figure 10:
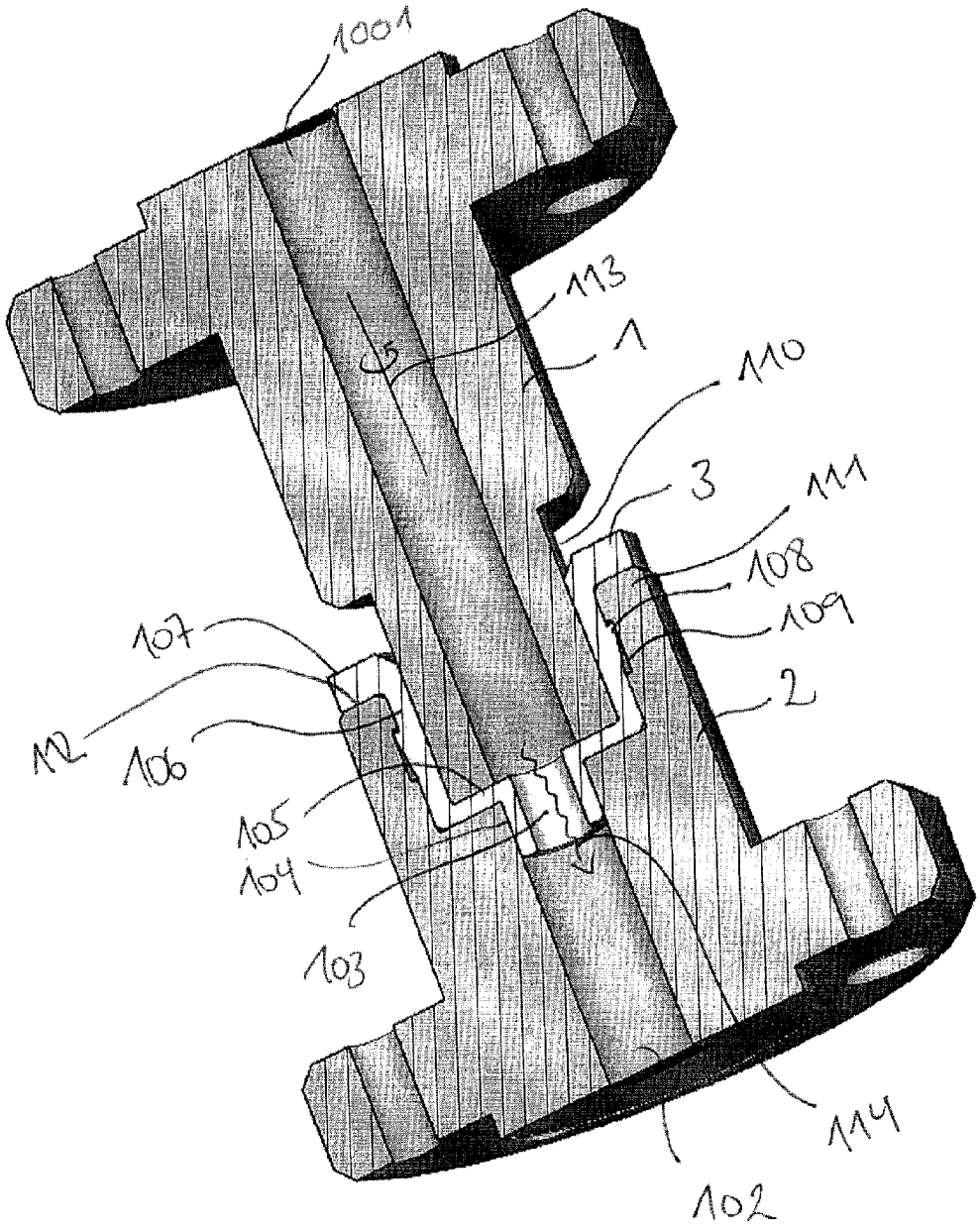
FIG. 10 shows a second waveguide and a separation element being part of an antenna and an external first waveguide according to an exemplary embodiment of the present invention.

FIG. 10 shows a first waveguide 1 having a first inner diameter 1001. The first waveguide 1 is inserted into a separation element 3 which comprises a tubular section 103 having an inner diameter which is smaller than the inner diameter 1001 of the first waveguide 1. Furthermore, a second waveguide 2 is provided having a second inner diameter 102 which is bigger than the inner diameter 103 of the separation element 3.

The separation element 3 is inserted into the second waveguide 2 by a snap-and-click connection being realized by a nose section 108 of the separation element which engages a groove section 109 of the second waveguide 2.

The separation element 3 has an essentially rotational symmetry and tightly fits into the cylindrical recess of the upper part 111 of the second waveguide 2.

The separation element 3 consists of an upper, ring-shaped part 107 which abuts an upper surface 112 of the second waveguide 2, a cylindrical middle section 106 having multiple noses 108 at its outer surface (or a continuous nose like ring structure 108), a ring-like middle section 105 connecting the cylindrical middle section 106 with the tubular lower section 104.

The lower part 110 of the first waveguide 1 has a cylindrical shape and fits tightly into the cylindrical portion 106 of the separation element 3. Although the first waveguide 1 tightly fits into the cylindrical portion of the separation element 3, it may still be rotated around its longitudinal axis 113 after insertion, thus allowing to rotate a polarization plane of electromagnetic radiation 114 entering the second waveguide 2. In other words the radiation source can be rotated relative to the antenna after mounting the first waveguide 1 on the separation element 3.

The separation element 3 may be formed from plastic, for example PTFE. The tubular section 104 provides a leakage path or creepage distance of for example 2 mm.

Figure 11:
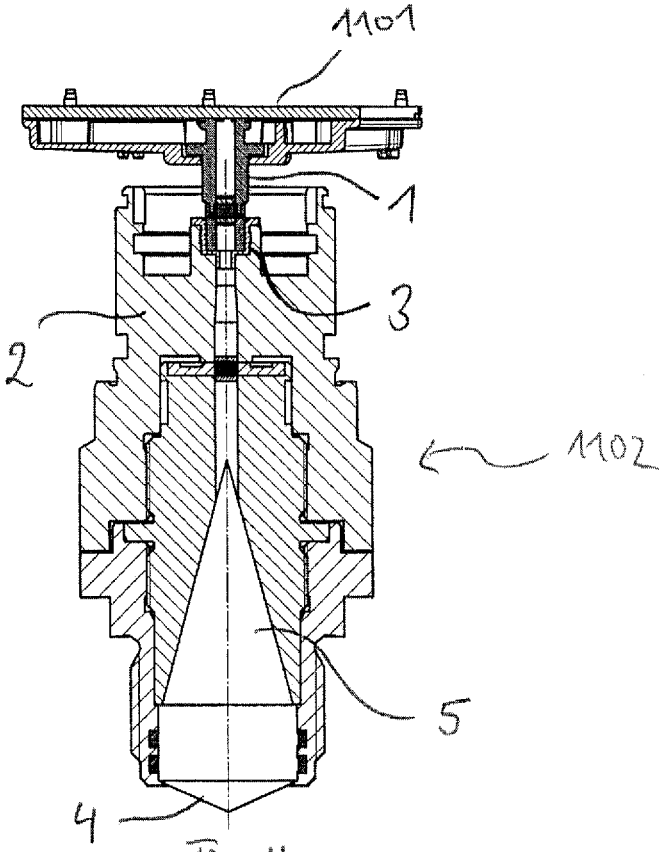
FIG. 11 shows a cross-sectional view of an antenna connected to a first waveguide according to an exemplary embodiment of the present invention.

FIG. 11 shows a cross-sectional view of an antenna 1102 connected to a first waveguide 1 according to an exemplary embodiment of the present invention. As can be seen from FIG. 11, the first waveguide 1 connects the electronic module, i.e. the radiation source 1101 to the separation element and thus to the second waveguide 2 leading to the antenna cone 5.

In other words, the separation element is part of the antenna 1102 and acts as galvanic insulation between the first waveguide and thus the radiation source and the second waveguide (which is part of the antenna). The separation element 3 further acts as a mechanical connection between the first waveguide and the second waveguide in form of a plug-in connection. Assembly of the antenna and the filling level electronics 1101 is thus simple.

The invention is particularly well suited to filling level measuring devices, but it is in no way limited to this field of application. The invention can be used wherever waveguides are to be insulated from each other, i.e. where a waveguide or a feed device is to be insulated from the antenna.

In addition it should be pointed out that "comprising" does not exclude other elements or steps, and "a" or "one" does not exclude a plural number. Furthermore, it should be pointed out that characteristics or steps which have been described with reference to one of the above embodiments can also be used in combination with other characteristics or steps of other embodiments described above. Reference characters in the claims are not to be interpreted as limitations.

The invention claimed is:

1. A filling level radar for determining a filling level in a tank, comprising:

a first waveguide having a constant inner diameter;

a second waveguide having a constant inner diameter that is equal to the inner diameter of the first waveguide and a cylindrical recess and being galvanically insulated from the first waveguide; and a separation element positioned between the first waveguide and the second waveguide, the separation element having a tubular end section with an inner diameter that is smaller than the inner diameters of the first and second waveguides and an outer diameter that is equal to the inner diameters of the first and second waveguides, the separation element being configured for tight insertion into the cylindrical recess of the second waveguide, wherein the separation element is configured to connect the first waveguide to the second waveguide and to galvanically insulate the first waveguide from the second waveguide, wherein the separation element includes a tubular section coaxially aligned with the first waveguide and the second waveguide.

2. The filling level radar according to claim 1, wherein the tubular section of the separation element has an axial length which is about four times larger than a thickness of the separation element.

3. The filling level radar according to claim 1, wherein the first waveguide has a first inner diameter; wherein the second waveguide has a second inner diameter; and wherein the tubular section of the separation element has a third inner diameter which is smaller than the first inner diameter and the second inner diameter.

4. The filling level radar according to claim 1, further comprising:

a radiation source configured to generate electromagnetic waves, wherein the first waveguide is designed to guide the electromagnetic waves from the radiation source to the separation element.

5. The filling level radar according to claim 1, wherein the second waveguide is part of an antenna.

6. The filling level radar according to claim 5, wherein a connection between one of (a) the separation element and the first waveguide and (b) the separation element and the second waveguide is designed such that the first waveguide is rotatably held relative to the antenna.

7. The filling level radar according to claim 5, further comprising:

a cross-section adaptor situated between the first waveguide and one of (a) the antenna and (b) the second waveguide in the region of the separation element, wherein the first waveguide in relation to a frequency of the signals to be transmitted is monomode-dimensioned, wherein at least one of the second waveguide and the antenna is multimode-capable, and wherein the cross-section adaptor is dimensioned in such a way that it generates one of (a) no higher modes and (b) only insignificantly higher modes than a fundamental mode.

8. The filling level radar according to claim 5, wherein the antenna is designed as a horn antenna.

9. The filling level radar according to claim 1, wherein the first waveguide and the second waveguide are designed as one of (a) a round waveguide and (b) a rectangular waveguide.

10. The filling level radar according to claim 5, wherein a region of overlap is provided between the first waveguide and the second waveguide; wherein the first waveguide is insulated from the second waveguide in the region of overlap by means of the separation element; wherein a feed device and the antenna are designed to transmit a signal with a wavelength of $\lambda$; and wherein in the region of overlap there is a gap which is approximately $\lambda/4$ in length.

11. The filling level radar according to claim 5, wherein a connection between one of (a) the separation element and the first waveguide, (b) the separation element and the second waveguide, and (c) the separation element and the antenna is constructed in the form of a plug-type connection so that the first waveguide can be unplugged from one of (a) the antenna and (b) the second waveguide.

12. The filling level radar according to claim 10, wherein the separation element is designed for thermally insulating the feed device from the antenna.

13. The filling level radar according to claim 1, wherein the separation element is formed from Polytetrafluoroethylene (PTFE).

14. The filling level radar according to claim 13, wherein the separation element is designed as a dielectric barrier that comprises a layer of rigid dielectric material.

15. An antenna for at least one of transmitting and receiving electromagnetic waves, comprising:

a second waveguide having a constant inner diameter and a cylindrical recess; and a separation element connecting the second waveguide to an external first waveguide that has a constant inner diameter that is equal to the inner diameter of the second waveguide, the separation element galvanically insulating the second waveguide from the first waveguide, the separation element including a tubular end section with a constant inner diameter coaxially aligned with the first waveguide and the second waveguide, the separation element being configured for tight insertion into the cylindrical recess of the second waveguide, wherein the inner diameter of the tubular end section is smaller than the inner diameters of the first and second waveguides, and wherein the tubular section has an outer diameter that is equal to the inner diameters of the first and second waveguides.

16. The antenna of claim 15, wherein the tubular section of the separation element has an axial length which is about four times larger than a thickness of the separation element.

17. The antenna of claim 15, wherein the first waveguide has a first inner diameter; wherein the second waveguide has a second inner diameter; and wherein the tubular section of the separation element has a third inner diameter which is smaller than the first inner diameter and the second inner diameter.

18. The antenna according to claim 15, further comprising:

a cross-section adaptor between the first waveguide and at least one of (a) the second waveguide and (b) the antenna in the region of the separation element, wherein the first waveguide in relation to a frequency of the signals to be transmitted is monomode-dimensioned;

wherein at least one of the second waveguide and the antenna is multimode-capable; and wherein the cross-section adaptor is dimensioned in such a way that it generates one of (a) no higher modes and (b) only insignificantly higher modes than a fundamental mode.

19. The antenna according to claim 18, wherein the cross-section adapter and the separation element are designed in the form of one of (a) a waterproof connection and (b) a gasproof connection between one of (a) the first waveguide and the second waveguide and (b) the first waveguide and the antenna.

20. The antenna according to claim 15, wherein the antenna is designed as a horn antenna.

21. A filling level radar for determining a filling level in a tank, comprising:

a first waveguide having a first inner diameter;

a second waveguide having a second inner diameter and a cylindrical recess and being galvanically insulated from the first waveguide; and a separation element positioned between the first waveguide and the second waveguide, the separation element having a tubular end section with a third inner diameter that is smaller than the first inner diameter and the second inner diameter, the separation element being configured for tight insertion into the cylindrical recess of the second waveguide, wherein the separation element is configured to connect the first waveguide to the second waveguide and to galvanically insulate the first waveguide from the second waveguide, wherein the separation element includes a tubular section coaxially aligned with the first waveguide and the second waveguide, wherein the separation element is adapted for being inserted into the second waveguide;

wherein the separation element comprises a nose section;

wherein the second waveguide comprises a groove section; and wherein the nose section engages the groove section thus forming a releasable connection between the separation element and the second waveguide when the separation element is inserted into the second waveguide.

22. An antenna for at least one of transmitting and receiving electromagnetic waves, comprising:

a second waveguide having a second inner diameter and a cylindrical recess; and a separation element connecting the second waveguide to an external first waveguide that has a first inner diameter, the separation element galvanically insulating the second waveguide from the first waveguide, the separation element including a tubular end section with a third inner diameter coaxially aligned with the first waveguide and the second waveguide, the separation element being configured for tight insertion into the cylindrical recess of the second waveguide, wherein the third inner diameter is smaller than the first and second inner diameters, wherein the separation element is configured to be inserted into the second waveguide, the separation element including a nose section, the second waveguide including a groove section, the nose section engaging the groove section thus forming a releasable connection between the separation element and the second waveguide when the separation element is inserted into the second waveguide.

* * * * *